US006244920B1

(12) United States Patent
de Baan

(10) Patent No.: US 6,244,920 B1
(45) Date of Patent: Jun. 12, 2001

(54) MOORING ASSEMBLY FOR MOORING A BODY, FLOATING ON A WATER MASS

(75) Inventor: Jacob de Baan, Maasslus (NL)

(73) Assignee: Bluewater Terminal Systems N.V. (NL)

( * ) Notice: Subject to any disclaimer, the term of this patent is extended or adjusted under 35 U.S.C. 154(b) by 0 days.

(21) Appl. No.: 09/535,363

(22) Filed: Mar. 24, 2000

(30) Foreign Application Priority Data

Sep. 17, 1999 (NL) ..... 1013075

(51) Int. Cl.[7] ..... B63B 22/00
(52) U.S. Cl. ..... 441/3; 114/230.1
(58) Field of Search ..... 441/3–5; 114/230.1, 114/230.12, 230.13, 230.14, 230.15, 230.17, 230.18, 230.19

(56) References Cited

U.S. PATENT DOCUMENTS 4,606,294 * 8/1986 Di Tella et al. ..... 441/5
4,917,038 * 4/1990 Poldervaart et al. ..... 441/3

FOREIGN PATENT DOCUMENTS

219191 * 11/1985 (JP) ..... 441/3

* cited by examiner

*Primary Examiner*—Jesus D. Sotelo
(74) *Attorney, Agent, or Firm*—Rashida A. Karmali

(57) ABSTRACT

Starting from a mooring assembly with a fixed mooring point and the combination of at least one rigid arm which, in the moored position, lies above the water surface, a rigid connecting element connected by means of a pivot point therewith and being essentially vertical at rest, and a weight, connected to the assembly and producing at movements of the floating body to and from the mooring point resetting forces acting upon this body in that the ends of the rigid arm and the connecting element respectively, opposite the first pivot point, are connected either with the mooring point on the one hand and the floating body on the other hand or with the floating body on the one hand and the mooring point on the other hand, the invention proposes that the weight is connected to the rigid connecting element. As a result the structure of the rigid arm can be simpler and the assembly will be easier to use.

5 Claims, 3 Drawing Sheets

MOORING ASSEMBLY FOR MOORING A BODY, FLOATING ON A WATER MASS

BACKGROUND OF THE INVENTION

The invention relates to an assembly for mooring a body, floating on a water mass, to a mooring point—such as a floating buoy, a mooring tower, a quay or another floating body, comprising the combination of at least one rigid arm which, in the moored position, lies above the water surface, a rigid connecting element connected therewith by means of a pivot point and being at rest essentially vertical, and a weight, connected to the assembly and producing, during movements of the floating body to and from the mooring point, resetting forces acting upon this floating body because the ends of the rigid arm and the connecting element respectively, which are opposite the first pivot point, are connected either to the mooring point on the one hand and the floating body on the other hand, or to the floating body on the one hand and the mooring point on the other hand.

DESCRIPTION OF THE PRIOR ART

Such an assembly is known in itself from EP 0 096 445 B1. According to this patent publication the weight which produces the resetting forces is provided on the rigid arm. This has as a drawback that the structure of this arm must be designed accordingly and in particular must be able to transfer the vertical forces, exerted thereon by the weight, to the pivot point between the rigid arm and the, at rest vertical, rigid connecting element, while the presence of the weight on or at the rigid arm has as a result that handling of this arm during the mooring and the loosening of the mooring respetively is cumbersome because, when the mooring installation is not in use, the lack of special supporting provisions will have as a result that the arm will disappear to below the water surface.

SUMMARY OF THE INVENTION

The invention aims to obviate these drawbacks and realises this by a method which is as simple as it is effective, namely in that according to the invention the weight is connected to the rigid connecting element. It can be a separate structural element fixed to the connecting element or be integrated in the structure of the connecting element, and in both cases be embodied as a container to be filled with a ballasting liquid.

As a result of the measures according to the invention the rigid arm can be considerably simpler and lighter because this rigid arm must now only take up pulling forces and no bending stresses; the fact that the weight is transferred from the rigid arm to the connecting element in no way deteriorates the operation of the mooring system as such.

DESCRIPTION OF A PREFERRED EMBODIMENT

Figure 1:
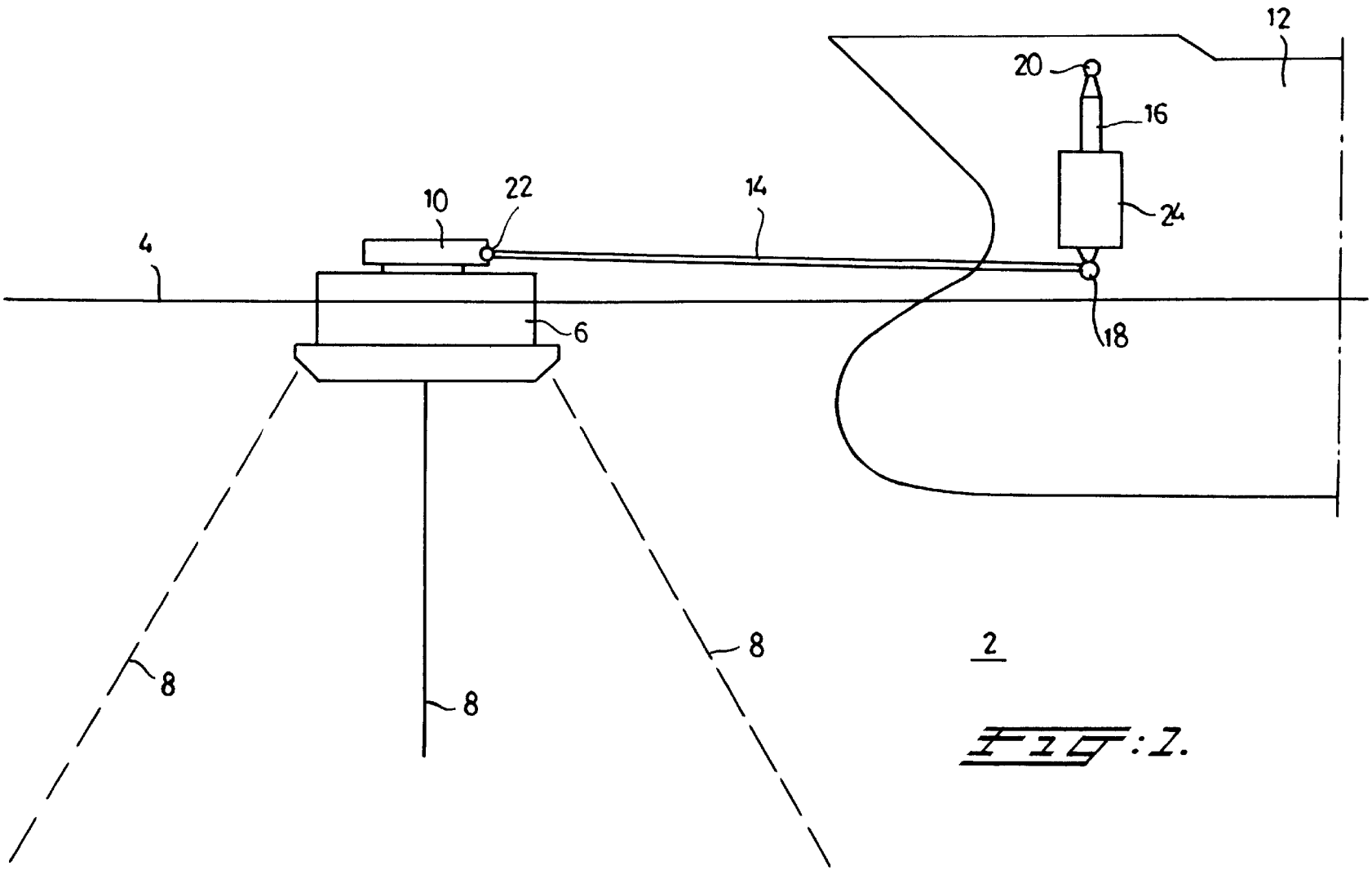
FIG. 1 is a schematic side view of a first embodiment of the invention.

In FIG. 1 reference numeral 2 denotes a water mass; the surface thereof is denoted with reference numeral 4.

On this water mass 2 floats a mooring buoy 6, connecting to the bottom by means of anchor chains 8; the buoy 6 carries the usual turn table 10.

The figure also shows a tanker 12 floating on the water mass and anchored to the buoy 6 by means of the combination of at least one, rigid, in this case horizontal arm 14 and a vertical connecting element 16. Arm 14 and connecting element 16 are interconnected in the first pivot point 18. The connecting element 16 is connected to the tanker 12 in a second pivot point 20 and the arm 14 is connected to the turntable 10, and therewith to the buoy 6, in a third pivot point 22. When there is sufficient possibility for the buoy to "tilt" this third pivot point can be omitted.

According to the invention the connecting element 16 carries a weight 24; this can be a separate structural part fixed to the connecting element 16 or can be integrated into the structure of the connecting element 16. During movements of the tanker 12 to and from the buoy 6 this weight 20 produces, in a manner which is known in itself, the desired resetting forces which bring the tanker back to its original position.

Figure 2:
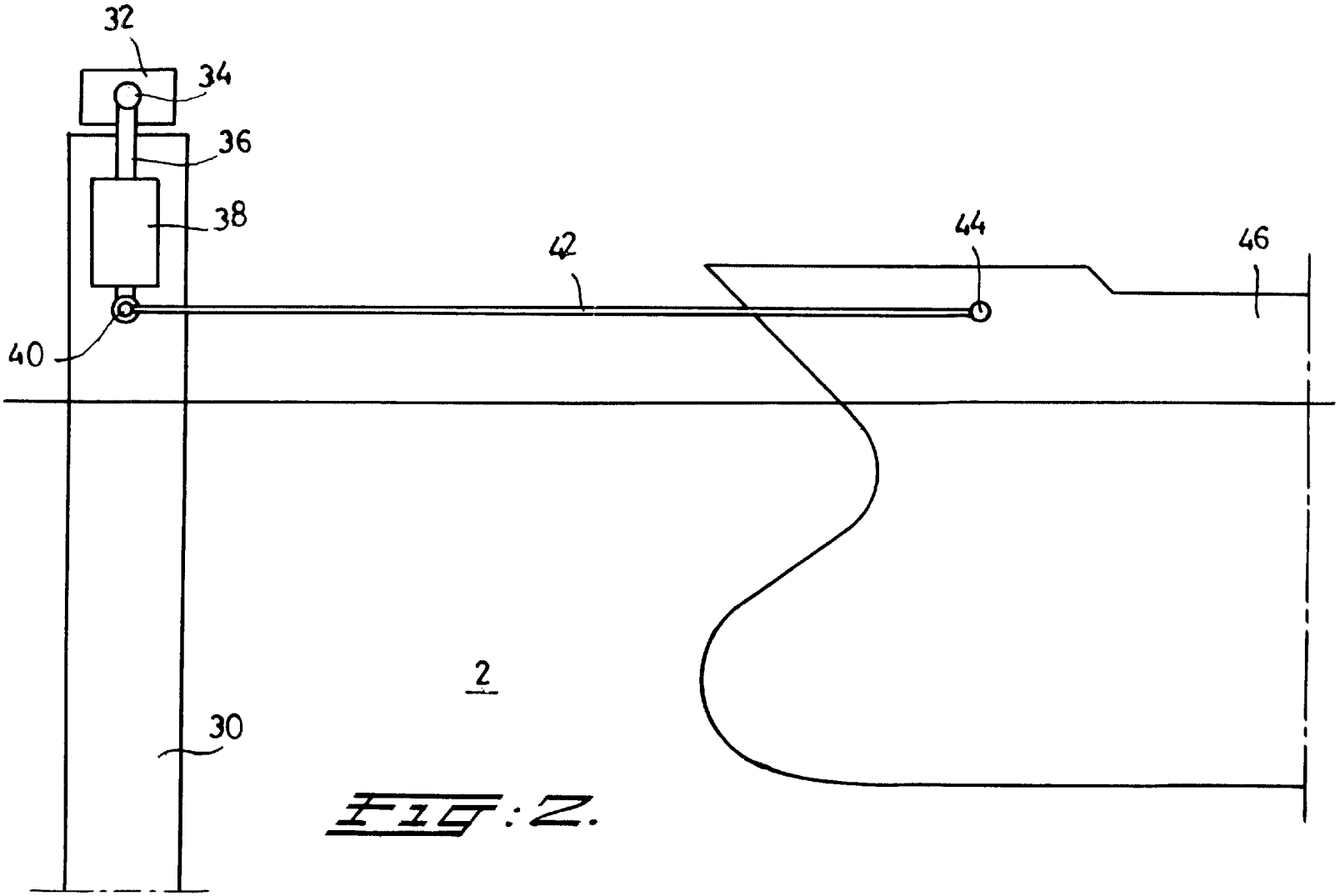
FIG. 2 is a schematic side view of a second embodiment according to the invention.

FIG. 2 shows an embodiment in which no use is made of a floating buoy 6 but of a rigid mooring tower 30 which rests on the bottom of a water mass 2, protrudes over a certain distance above the surface thereof and carries at the upper end the turntable 32. Via a pivot point 34 this turn table carries at least one rigid connecting element 36 with the weight 36 connected thereto; via the pivot point 40 the lower end of the connecting element 36 is connected with the, in this case horizontal, rigid arm 42, the other end of which is connected via the pivot point 44 with the tanker 46 which is moored to the tower 30. Here, too, the weight 36 can be a separate structural part fixed to the connecting element or can be integrated into the structure of the connecting element.

Figure 3:
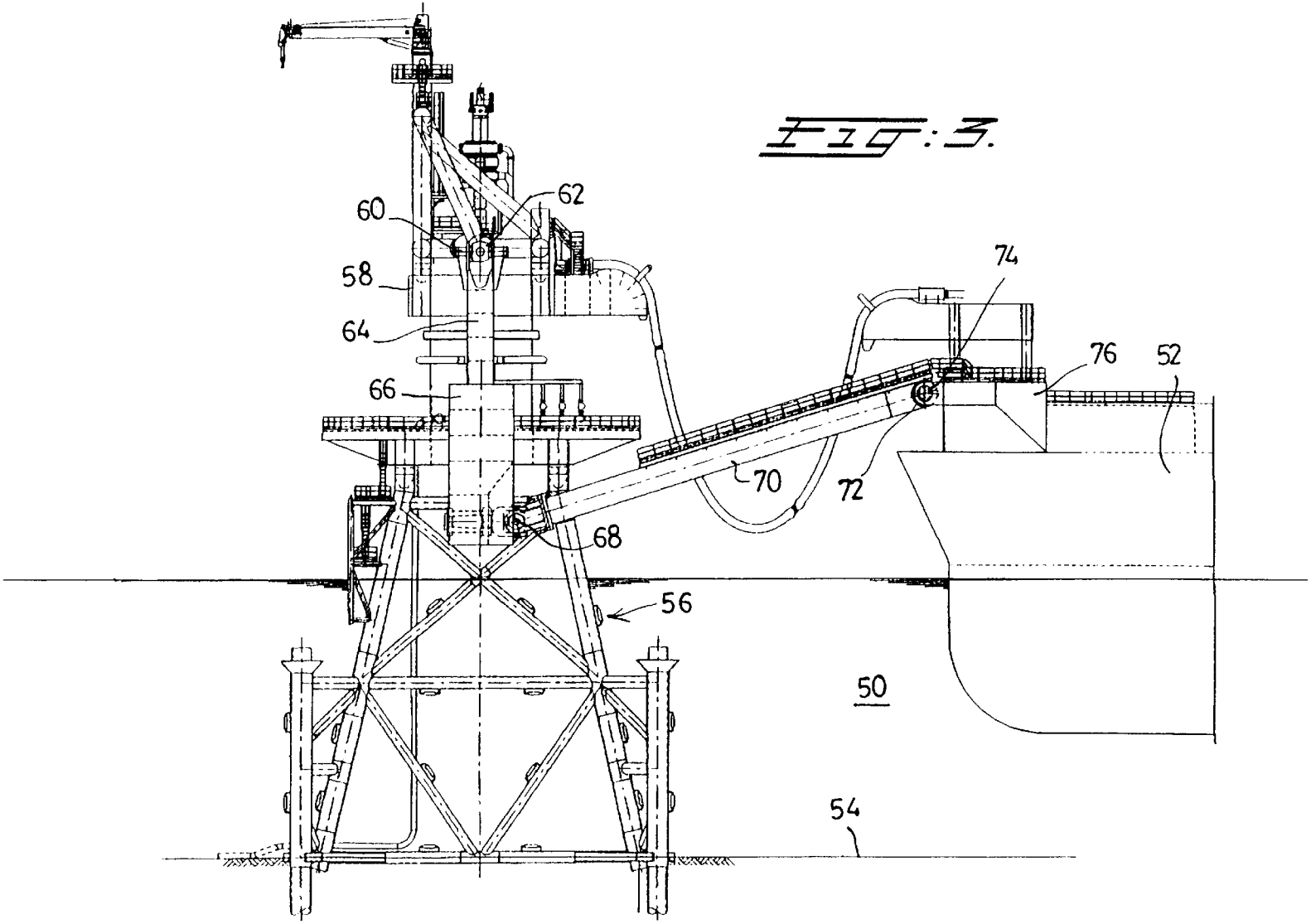
FIG. 3 is a view of an embodiment in which the invention is embodied.

FIG. 3 shows a more detailed view of a mooring asembly to which the measures according to the invention have been applied. The figure shows a water mass 50 with a tanker 52 floating thereon; a mooring tower structure 56 rests on the bottom 54. At the upper end this structure carries a turntable 58; at both sides thereof protrudes a horizontal arm of which one is shown and denoted with reference numeral 60. Each of the arms 60 carry a pivot point with horizontal pivot axes, one of which is shown, denoted with 62, and each such a pivot point supports a depending rigid connecting element 64. Each such connecting element carries a weight 66 which, in this case, is embodied as a container to be filled with a ballasting liquid (ballast water). At the lower end of each connecting element 64 there is a horizontal pivot point 68; each such pivot point is connected to one of the two ends of a rigid yoke 70, the other end 72 of which is connected via the horizontal pivot point 74 to the mooring structure 76 at the bow of the tanker 52.

Of course the proposed asembly can also be used for mooring a floating body to a quay or another floating body, while, as will be clear from the foregoing, the rigid arm need not be always horizontal. One can also use two combinations which are mutually independently movable: rigid arm/connecting element.

What is claimed is:

1. An assembly for mounting a body floating on a water mass, said assembly being moored to a mooring point including a floating buoy, a mooring tower, a quay or a second floating buoy, said assembly comprising:

at least one rigid arm having a first end and a second end, and the first end being connected to the mooring point such that said assembly lies in the moored position above the surface, a rigid connecting element having a first end and a second end, said first end of the rigid connecting element is connected to the second end of the rigid arm by means of a first pivot point, and the second end of the rigid connecting element is connected by means of a second pivot point, such that the second pivot point lies above the first pivot point and said second pivot point is connected by a weight to the rigid arm between the first and second pivot points.

2. The assembly according to claim 1, wherein the weight is a separate structural part fixed to the rigid connecting element.

3. The assembly according to claim 1 wherein the weight is integrated into the structure of the rigid connecting element.

4. The assembly according to claim 1, wherein the weight is embodied as a container filled with ballast liquid.

5. The assembly according to claim 1, wherein the rigid arm comprises a rigid yoke having a first end and a second end, said first and second ends being connected to the rigid connecting element.

* * * * *